United States Patent [19]

Iwanaka et al.

[11] Patent Number: 4,637,489

[45] Date of Patent: Jan. 20, 1987

[54] ELECTROACOUSTIC TRANSDUCER

[75] Inventors: Masaya Iwanaka, Kanagawa; Seiji Kajiwara, Tokyo, both of Japan

[73] Assignees: Nippon Chem-Con Corp., Tokyo; Hideo Koide, Aichi, both of Japan

[21] Appl. No.: 772,535

[22] Filed: Sep. 4, 1985

[30] Foreign Application Priority Data

Sep. 4, 1984 [JP] Japan ..... 59-185694

[51] Int. Cl.[4] ..... G10K 13/00

[52] U.S. Cl. ..... 181/160; 381/91; 381/158

[58] Field of Search ..... 181/157, 158, 160; 179/179, 180, 182 R; 381/91

[56] References Cited

U.S. PATENT DOCUMENTS

| | | | |
|---|---|---|---|
| 3,240,883 | 3/1966 | Seeler | 181/158 X |
| 3,246,721 | 4/1966 | Martin | 181/160 |
| 4,054,748 | 10/1977 | Balogh | 181/199 X |
| 4,189,627 | 2/1980 | Flanagan | 181/160 X |

*Primary Examiner*—Benjamin R. Fuller

*Attorney, Agent, or Firm*—Sughrue, Mion, Zinn Macpeak & Seas

[57] ABSTRACT

An electroacoustic transducer has a front air chamber in front of the diaphragm that vibrates upon receiving sound waves or produces sound waves upon vibration and a back air chamber provided in the rear of the diaphragm. The electroacoustic transducer of the present invention further includes an auxiliary air chamber that is provided in the rear of the back air chamber that is coupled thereto by through holes. The auxiliary air chamber is divided into at least two smaller air chambers which are coupled to each other by a small orifice.

4 Claims, 13 Drawing Figures

ELECTROACOUSTIC TRANSDUCER

BACKGROUND OF THE INVENTION

The present invention relates to an electroacoustic transducer suitable for use in dynamic or electrostatic receiver or microphones that convert electrical signals to sound waves or vice versa.

Conventional dynamic receivers such as for use in telephone receivers employ a single diaphragm and a variety of methods have been proposed for realizing a broad flat frequency response using a single diaphragm. The construction of a typical dynamic receiver is shown in FIG. 11, wherein a casing generally indicated at 2 contains a first air chamber 6 in front of a diaphragm 4, as well as a coupler 10 that is disposed in front of the air chamber 6 with an intervening shield 8 having through holes 7 made in it. A coil 12 is disposed at the back of the diaphragm 4, and a cylindrical inner magnetic pole piece 14A surrounded by an annular outer magnetic pole piece 14B is also provided in the rear of the diaphragm 4. A second air chamber 16 is formed between the two magnetic pole pieces 14A and 14B. These magnetic pole pieces are attached to a wall plate 20 with an intervening paramagnetic plate 18 that forms a magnetic circuit together with the magnetic pole piece 14A. The wall plate 20 is provided with through holes 22 communicating with the second air chamber 16. At the back of the wall plate 20 is provided a third air chamber 26 that is coupled to the second air chamber 16 by the through holes 22.

An equivalent circuit of the dynamic receiver described above is shown in FIG. 12, wherein Sc stands for the stiffness of the coupler 10, S1 the stiffness of the first air chamber 6, S2 the stiffness of the second air chamber 16, S3 the stiffness of the third air chamber 26, S0 the stiffness of the diaphragm 4, Mo the mass (effective mass) of the diaphragm 4, M1 the mass of the through holes 7, m2 the mass of the through holes 22, r2 the damping resistance of the through holes 22, and F0 the driving source.

The principal elements of the dynamic receiver represented by the circuit of FIG. 12 that are associated with frequencies in the higher range are the stiffness S2 of the second air chamber 16, the mass m2 of the through holes 22 and the damping resistance r2 of the through holes 22. These elements are closely related to one another and it is very difficult to obtain the appropriate value of one element without being affected by another. As a result, the dynamic receiver has a frequency response typically shown in FIG. 13 wherein P1 and P2 represent peaks while D denotes a dip.

Such characteristics are highly deleterious to the quality of sound reproduced from the receiver. One of the approaches conventionally taken to avoid this problem is to provide an additional damping resistance by filling the through holes 22 with fiberglass. This method however is not suitable for mass production of receivers for several reasons such as non-uniformity in the characteristics of the products.

In addition to this difficulty in mass production, the adjustment of the damping resistance by the use of fiberglass causes other problems such as a complicated acoustic structure of the receiver and time- or environment-dependent changes of its frequency response.

SUMMARY OF THE INVENTION

The primary object, therefore, of the present invention is to provide an electroacoustic transducer that allows for stable and reliable adjustment of the damping resistance by a simple structure and which can be mass-produced without sacrificing the uniformity of its frequency response.

In order to achieve this object, the electroacoustic transducer of the present invention has a front air chamber in front of the diaphragm that vibrates upon receiving sound waves or produces sound waves upon vibration, a back air chamber in the rear of said diaphragm, and an auxiliary air chamber that is provided in the rear of said back air chamber and which is coupled thereto by through holes, said auxiliary air chamber being divided into at least two smaller air chambers which are coupled to each other by a small orifice.

In accordance with the present invention, the auxiliary air chamber provided at the back of the rear air chamber is divided into two smaller air chambers which are coupled to each other by the small orifice. As a result, the transducer of the invention has an auxiliary circuit additionally provided by the auxiliary air chamber. This auxiliary circuit is added in parallel to the stiffness S3 of the third air chamber in the conventional electroacoustic transducer. Because of this auxiliary circuit, the damping resistance of the transducer as well as its phase are sufficiently corrected to provide a broad flat frequency response without affecting such elements as the mass of the through holes in the back air chamber and the stiffness of the latter.

DETAILED DESCRIPTION OF THE PREFERRED EMBODIMENTS

The present invention will be described in detail with reference to the accompanying drawings.

Figure 1:
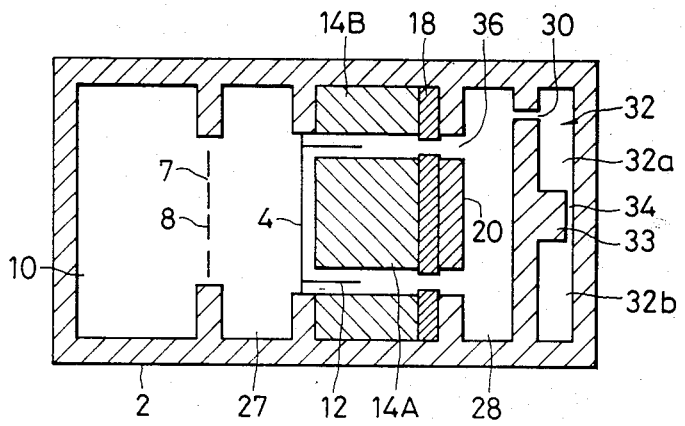
FIG. 1 is a cross section showing an embodiment of the electroacoustic transducer of the present invention.
Figure 11:
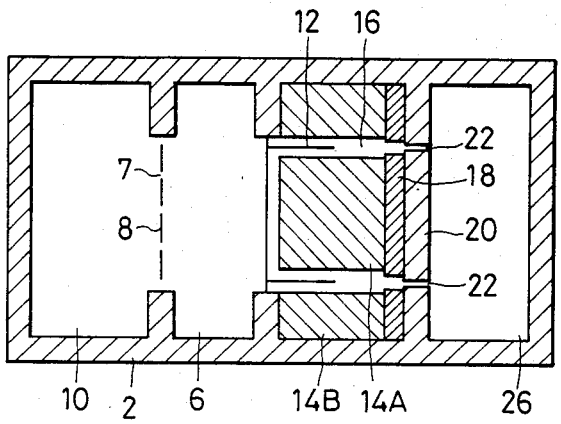
FIG. 11 is a cross section showing the construction of a convetnional electroacoustic transducer.

FIG. 1 shows one embodiment of the electroacoustic transducer of the present invention and the components which are the same as those shown in FIG. 11 are identified by like numerals. As in FIG. 11, the transducer shown in FIG. 1 has a casing 2 which contains a diaphragm 4 that converts audiofrequency current variations and other electrical signals into sound waves. A front air chamber 27 is disposed in front of the diaphragm 4 and a coil 12 is provided in the rear of the diaphragm 4. Also, provided at the back of the diaphragm 4 are magnetic pole pieces 14A and 14B, as well as a back air chamber 28. An auxiliary air chamber 32 is provided in the rear of the back air chamber 28 and the two chambers are coupled to each other by through holes 30. The auxiliary air chamber 32 is divided by a bridge 33 into at least two smaller air chambers **32*a* and 32*b* which are coupled to each other by a small orifice 34**.

The back air chamber 28 shown in FIG. 1 serves as both the second air chamber 16 and the third air chamber 26 included in the conventional electroacoustic transducer shown in FIG. 11. Through holes 36 are formed in this rear air chamber 28.

A coupler 10 is provided in front of the front air chamber 27 with an intervening shield plate 8 having through holes 7.

Figure 12:
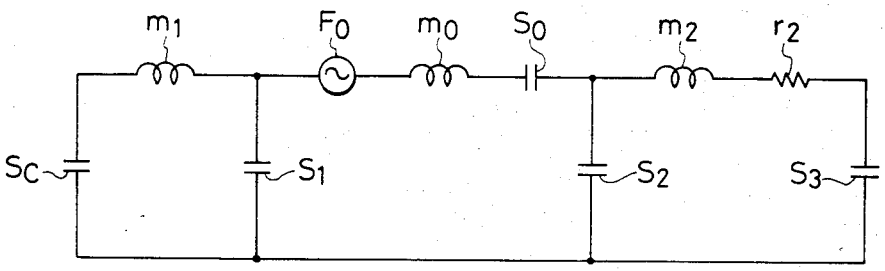
FIG. 12 is a diagram showing an equivalent circuit of the transducer shown in FIG. 11.
Figure 13:
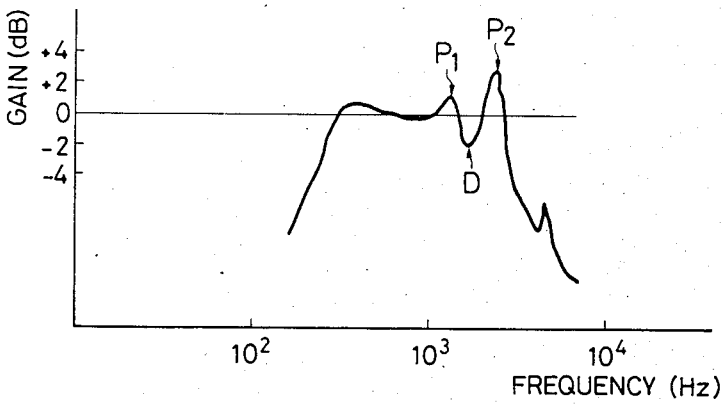
FIG. 13 is a diaphragm illustrating the frequency response of the transducer shown in FIG. 11.

The electroacoustic transducer of the present invention having the construction described above operates by the following principles. The auxiliary air chamber 32 disposed in the rear of the back air chamber 28 is divided into the two smaller air chambers **32*a* and 32*b* which are coupled to each other by the small orifice 34. Therefore, as shown in FIG. 2, an equivalent circuit of the transducer of the invention differs from the circuit shown in FIG. 12 in that the former has an auxiliary circuit 38 additionally provided by the auxiliary air chamber 32**.

Figure 2:
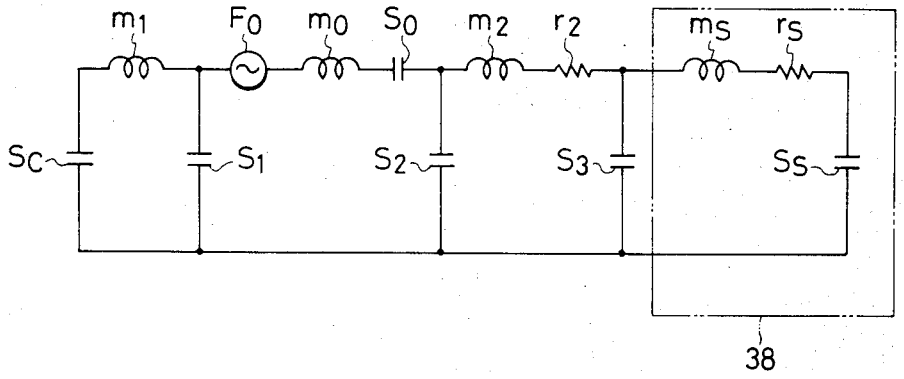
FIG. 2 is a diagram showing an equivalent circuit of the transducer shown in FIG. 1.

In FIG. 2, S2 represents the stiffness of the front portion (corresponding to the second air chamber 16 in FIG. 11) of the back air chamber 28; m2 the mass of the through holes 30; r2 the damping resistance of the through holes 30; S3 the stiffness of the small air chamber **32*a* (corresponding to the third air chamber 26 in FIG. 11) of the back air chamber 28; ms the mass of the small orifice 34; rs the damping resistance of the small orifice 34; and Ss the stiffness of the small air chamber 32*b***.

As is clearly shown in the equivalent circuit of FIG. 2, the electroacoustic transducer of the present invention has the auxiliary circuit 38 provided additionally in parallel to the stiffness S3 of the third air chamber in the conventional transducer. Because of this auxiliary circuit, the damping resistance r2 of the transducer as well as its phase are sufficiently corrected to provide a broad flat frequency response without affecting such elements as the mass m2 of the through holes 36 in the back air chamber 28 and the stiffness S3 of that air chamber.

FIGS. 3 to 6 show a specific application of the electroacoustic transducer illustrated in FIGS. 1 and 2, and the components which are the same as those shown in FIG. 1 are identified by like numerals. The transducer shown in FIGS. 3 to 6 is intended for use as a telephone receiver.

Figure 3:
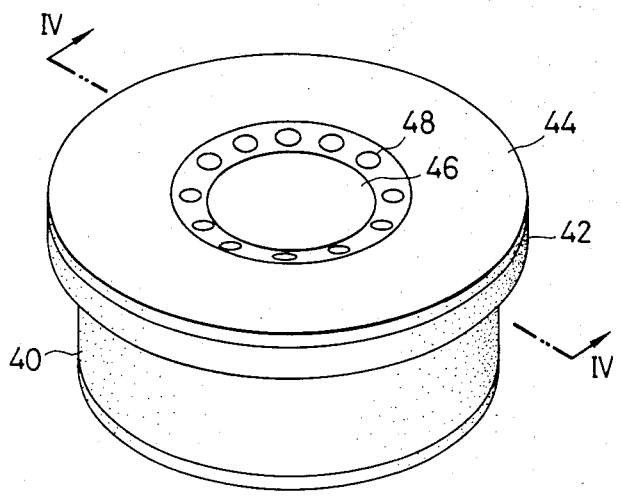
FIG. 3 is a perspective view showing a telephone receiver which is a practical application of the electroacoustic transducer of the present invention.

The receiver shown in FIG. 3 has a casing 40 that is molded from a synthetic resin, e.g., ABS resin, in a cylindrical form and which has a flange 42 formed in the front portion. The flange 42 has in its front portion a cylindrical front shield 44 that is also molded in a cylindrical form from the same synthetic resin as used in the casing 40. The shield 44 has a center cavity 46 with an inclined side wall which has a plurality of through-holes 48 formed at given spacings.

Figure 4:
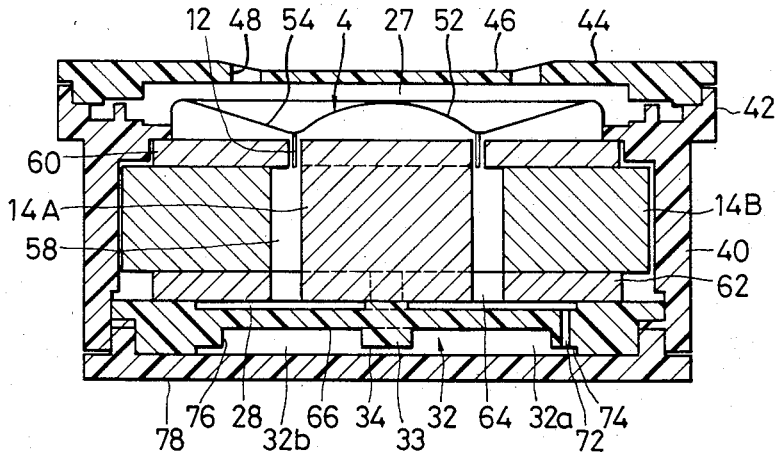
FIG. 4 is a cross section of FIG. 3 taken along line IV-IV.

As shown in FIG. 4, a front air chamber 27 and a diaphragm 4 which is fixed at the edge portion to the flange 42 on the casing 40 are provided in the rear of the front shield 44. The diaphragm 4 has a spherical projection 52 in the center, from which a conical ring 54 extends to provide a predetermined parabolic plane. The periphery of the conical ring 54 is curved to provide good fit to the flange 42. A cylindrical coil 12 is provided at the back of the diaphragm 4 in the circular area corresponding to the periphery of the projection 52.

Figure 5:
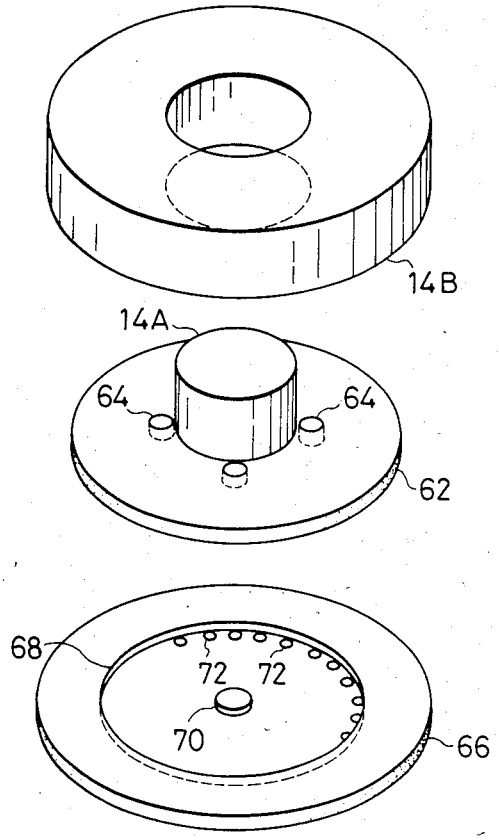
FIG. 5 is an exploded view showing the arrangement of magnetic pole pieces and a partition.

As shown in FIG. 5, a cylindrical inner magnetic pole piece 14A and an annular outer magnetic pole piece 14B which forms a given gap 58 with the inner magnetic pole piece 14A are also provided at the back of the diaphragm 4. An annular paramagnetic plate 60 that forms a magnetic circuit with the inner magnetic pole piece 14A is fixed in front of the outer magnetic pole piece 14B. The coil 12 is inserted into the gap formed between the paramagnetic plate 60 and the inner magnetic pole piece 14A.

A flange 62 that forms a magnetic circuit with the outer magnetic pole piece 14B is provided at the back of the inner magnetic pole piece 14A. This flange 62 is provided with a plurality of spaced through holes 64 that are joined with the gap 58. A partition 66 is provided in the rear of the flange 62 to define a back air chamber 28. This back air chamber 28 is coupled to the gap 58 by the through holes 64 formed in the flange 62.

As shown in FIG. 5, the partition 66 has a circular recess 68 that defines the back air chamber 28 and a cylindrical projection 70 is formed in the center of the recess. In the embodiment shown, a plurality of through holes 72 are formed at spacings of 15° on the peripheral edge of the recess 68 in a region not exceeding one half the circumference of its periphery.

Figure 6:
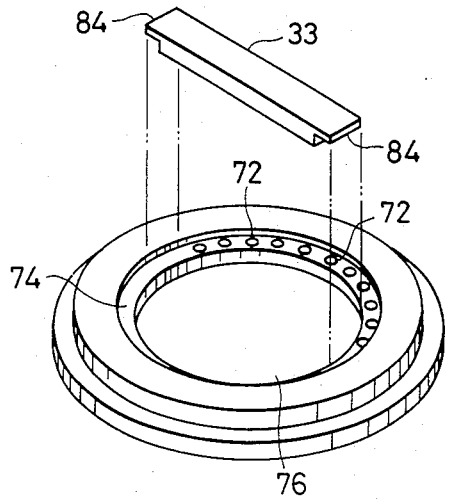
FIG. 6 is an exploded view showing the construction of the rear side of the partition.

An auxiliary air chamber 32 is provided in the rear of the partition 66 and this auxiliary air chamber 32 is coupled to the back air chamber 28 by the through holes 72. As shown in FIG. 6, the partition 66 in the illustrated embodiment has a step 74 on the back side to form a recess 76 for defining the auxiliary air chamber 32, and the through holes 72 are formed in the step 74.

The casing 40 is closed with a back closure plate 78 that is posistioned in the rear of the partition 66. The auxiliary air chamber 32 is formed by the recess 76 in the partition 66 and the back closure plate 78.

A bridge 33 is formed in the recess 76; this bridge 33 divides the auxiliary air chamber 32 into two smaller air chambers **32*a* and 32*b* which are coupled to each other by a small orifice 34. As shown in FIG. 6, the bridge 33 traverses the recess 76 and the step 74 in the diametrical direction and has a flange 84 formed at both ends of its length by which it is fixed to the step 74. In the illustrated embodiment, the smaller air chamber 32*a* is defined on the side of the through holes 72 and is coupled to the other smaller air chamber 32*b* by the small orifice 34**.

In accordance with the arrangement shown above, the auxiliary circuit 38 is additionally provided by the auxiliary air chamber 32 as shown in FIG. 2, and this permits the damping resistance of the back air chamber 28 to be corrected together with its phase. Furthermore, this arrangement is simple and enables the mass production of telephone receivers having consistently uniform characteristics.

Figure 7:
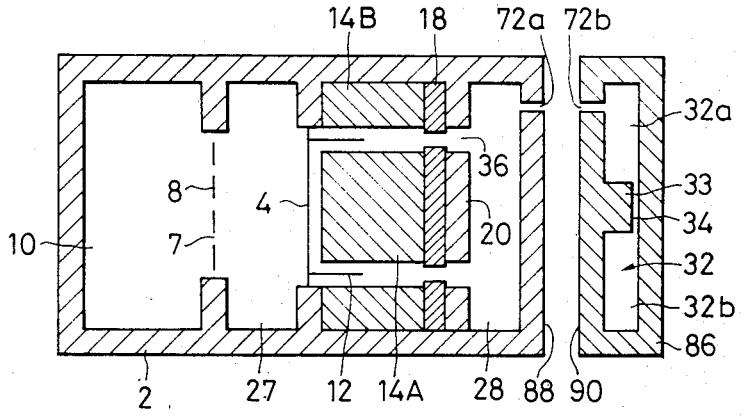
FIG. 7 is a cross section showing another embodiment of the electroacoustic transducer of the invention.

As shown in FIG. 7, the auxiliary air chamber 32 may be provided as a module by forming it within an auxiliary casing 86. In this modification, through holes **72*a* formed in a back closure plate 88 that closes the back air chamber 28 are coupled to through holes 72 formed in a front closure plate 90 that closes the auxiliary casing 86, thereby connecting the auxiliary air chamber 32 to the back air chamber 28**.

One advantage of using the auxiliary air chamber 32 in a modular form lies in its ability to realize a desired change in frequency characteristics, and another advantage is the ability to obtain a desired frequency response without necessitating a considerable change in the construction of the conventional telephone receiver.

In the illustrated embodiment, the small orifice 34 is formed between the back closure plate 78 and the bridge 33, but it may be formed between the partition 66 and the bridge 33. The small orifice 34 may be formed by inserting a spacer of a given thickness in the gap where said orifice is to be formed. The auxiliary air chamber 32 may be divided into three, rather than two, smaller air chambers and a desired frequency response may be obtained by properly adjusting the size of two or more small orifices 34 by which the individual smaller chambers are coupled. In the embodiment shown, eleven through holes 72 are formed at spacings of 15° but the object of the invention is equally achieved by forming either an increased number of smaller holes or a decreased number of larger holes.

EXPERIMENT

Figure 8:
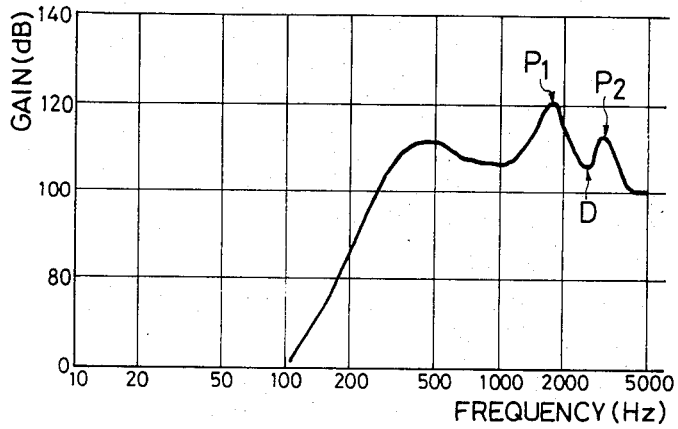
FIGS. 8 to 10 are frequency response diagrams.
Figure 9:
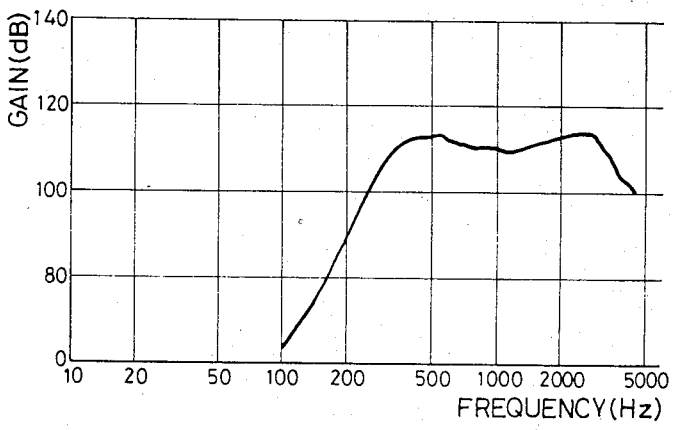
Figure 10:
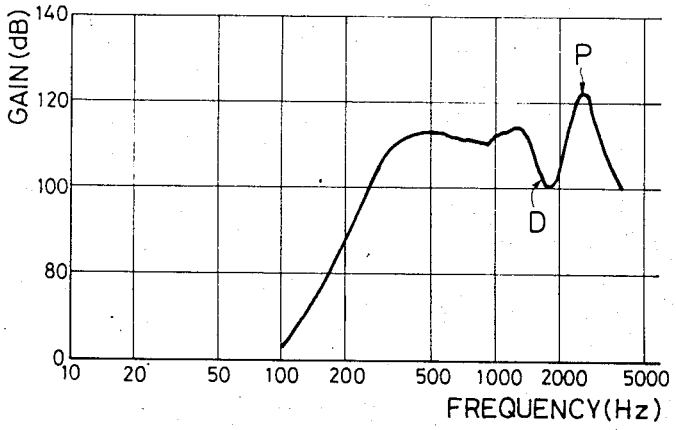

Three units of telephone receivers having the construction shown in FIGS. 3 to 6 were prepared; one unit did not have the small orifice 34, while the other two used orifices having different diameters, 100 μm and 200 μm. The frequency responses of the three units are shown in FIGS. 8 to 10, wherein 0 dB (reference) corresponds to a sound pressure of 20 micropascals. The data in FIGS. 8 to 10 were obtained with an input power of 1 milli-watt.

FIG. 8 shows the frequency response of the unit having no small orifice 34; apparently, two peaks P1 and P2, as well as one dip D occurred. FIG. 9 shows the frequency response of the unit wherein the diameter of orifice 34 was set to 100 μm; it had no distinct peaks or dips and provided broad flat frequency characteristics that make the unit suitable for use as a telephone receiver. FIG. 10 shows the frequency response of the unit wherein the diameter of the orifice was sent to 200 μm; as in the case of FIG. 9, the response shown in FIG. 10 had a rather distinct dip D and peak P.

By comparing the data shown in FIGS. 8 to 10, it will be clearly seen that the effective size of the orifice 34 is in the neighborhood of 100 μm.

The foregoing described concerns a dynamic electroacoustic transducer that converts electrical signals to sound waves. It should however be understood that the concept of the invention can equally be applied to other types of electroacoustic transducers such as a dynamic transducer that converts sound waves to electrical signals, an electrostatic transducer that converts sound waves to electrical signals such as in case of an electret condenser microphone, and an electrostatic transducer that converts electrical signals to sound waves.

In accordance with the present invention, the damping resistance of an electroacoustic transducer is sufficiently corrected by a simple construction to provide a broad flat frequency response and products having consistent and uniform frequency characteristics can be manufactured in high volumes.

What is claimed is:

1. An electroacoustic transducer comprising:

a diaphragm having a front side and a rear side;

a front air chamber provided on the front side of the diaphragm, said diaphragm vibrating upon receiving sound waves and producing sound waves upon vibration, said front air chamber having first through holes positioned at a first end thereof;

a back air chamber, provided on the rear side of said diaphragm and behind said front air chamber, said back air chamber being formed integrally with said front air chamber, said back air chamber being communicated with said front air chamber via said first through holes, said back air chamber having second through holes at a rear end thereof; and an auxiliary air chamber, provided in the rear of said back air chamber and which communicates with said auxiliary air chamber by said second through holes, said auxiliary air chamber being divided into first and second smaller air chamber, said second smaller air chamber not being communicated with said back air chamber, but being communicated with said first smaller air chamber by a small orifice, said auxiliary air chamber including a bridge extending from one wall of said auxiliary air chamber toward an opposing wall to form said small orifice.

2. An electroacoustic transducer according to claim 1 wherein said auxiliary chamber comprises a module which is attached to the rear of said back air chamber.

3. An electroacoustic transducer according to claim 1, wherein said small orifice is between 100 and 200 μm wide.

4. An electroacoustic transducer according to claim 1, wherein said small orifice is approximately 100 μm wide.

* * * * *